US006866522B2

(12) United States Patent
Terashima et al.

(10) Patent No.: US 6,866,522 B2
(45) Date of Patent: Mar. 15, 2005

(54) ELECTRICAL CONNECTOR

(75) Inventors: Toshihiro Terashima, Osaka (JP); Terumi Nakashima, Osaka (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/787,184

(22) Filed: Feb. 27, 2004

(65) Prior Publication Data

US 2004/0175971 A1 Sep. 9, 2004

(30) Foreign Application Priority Data

Mar. 7, 2003 (JP) ..... 2003-062203

(51) Int. Cl.[7] ..... H01R 9/09
(52) U.S. Cl. ..... 439/74
(58) Field of Search ..... 439/74, 83, 374, 439/570, 660

(56) References Cited

U.S. PATENT DOCUMENTS 5,626,482 A * 5/1997 Chan et al. ..... 439/74
5,931,689 A * 8/1999 Patel ..... 439/346
6,132,258 A * 10/2000 Kajinuma ..... 439/660

FOREIGN PATENT DOCUMENTS

JP 07-94241 A1 4/1995

* cited by examiner

*Primary Examiner*—Thanh-Tam Le
(74) *Attorney, Agent, or Firm*—Rader, Fishman & Grauer PLLC

(57) ABSTRACT

An electrical connector comprises first and second connectors connectable to each other in a predetermined connecting direction. The first connector comprises a housing, a plurality of contacts supported by the housing, and a metal reinforcement member fixed to the housing. The reinforcement member is engageable with an engagement groove of the second connector. The reinforcement member includes a pair of engagement projections. The first and second connectors are permitted to be offset from each other in a direction intersecting the connecting direction and guided with respect to each other for connection thereof when the engagement projections are introduced into the engagement groove.

9 Claims, 6 Drawing Sheets

ELECTRICAL CONNECTOR

CROSS REFERENCE TO RELATED APPLICATION

This application corresponds to Japanese Patent Application No. 2003-62203 filed with the Japanese Patent Office on Mar. 7, 2003, the disclosure of which is incorporated herein by reference.

BACKGROUND OF THE INVENTION

1. Field of the Invention

The present invention relates to an electrical connector to be used for board-to-board connection and board-to-wire connection.

2. Description of Related Arts

In a conventional guide arrangement for connection of electrical connectors, one of the electrical connectors has a projection of a synthetic resin provided integrally with a housing thereof, and the other electrical connector has a groove provided in a housing thereof, whereby the projection of the one electrical connector is engaged with the groove of the other electrical connector for the connection of the electrical connectors (see, for example, Japanese Unexamined Patent Publication No. 7-94241 disclosed on Apr. 7, 1995).

Meanwhile, an electrical connector for a personal computer, a mobile phone or the like has recently been demanded to have a height of, for example, not greater than about 2 mm. When the guide arrangement including the synthetic resin components as disclosed in the aforesaid patent publication is employed, the size reduction of the electrical connector is difficult.

This is because the electrical connector is liable to deform if the synthetic resin housing thereof has a thinner wall and the synthetic resin projection thereof has is smaller. Therefore, the electrical connectors cannot be properly positioned to each other for the connection. This makes a connecting operation difficult, and leads to damages to the housing and contacts. Hence, the electrical connector has an increased size with difficulty in the size reduction of the projection thereof.

If an attempt is made to provide a sufficient guide clearance for assuredly guiding the connector to a due position and accommodating a gap in the connection of the connector, the wall thickness of the housing having a smaller size should further be reduced. This results in insufficient physical strength of the housing, and makes it difficult to mold the housing from the resin because a mold volume sufficient to support the contacts cannot be maintained.

It is therefore an object of the present invention to provide an electrical connector which has a reduced size and yet ensures an easy connecting operation, and is free from the difficulty in the molding of a housing thereof.

SUMMARY OF THE INVENTION

According to one aspect of the present invention to achieve the aforesaid object, there is provided an electrical connector, which comprises: first and second connectors which are connectable to each other in a predetermined connecting direction; the first connector comprising a housing and a metal reinforcement member fixed to the housing, the reinforcement member being provided with an engagement projection; the second connector comprising an engagement groove engageable with the engagement projection; wherein the first and second connectors are permitted to be relatively slid from each other in a direction intersecting the connecting direction and guided to each other for connection thereof when the engagement projection is introduced into the engagement groove.

In the present invention, the engagement projection is provided on the metal reinforcement member which has a higher strength and a higher positioning accuracy. Even if the electrical connector has a smaller size, the first and second connectors are accurately guided to each other for connection thereof with a sufficient offset clearance provided therebetween. This contributes to the size reduction of the electrical connector. Further, the electrical connector can be molded from a resin without difficulty unlike a conventional connector which includes a housing provided with chamfers and the like for guiding.

DETAILED DESCRIPTION OF THE PREFERRED EMBODIMENT

A preferred embodiment of the present invention will be described with reference to the attached drawings.

Figure 8:
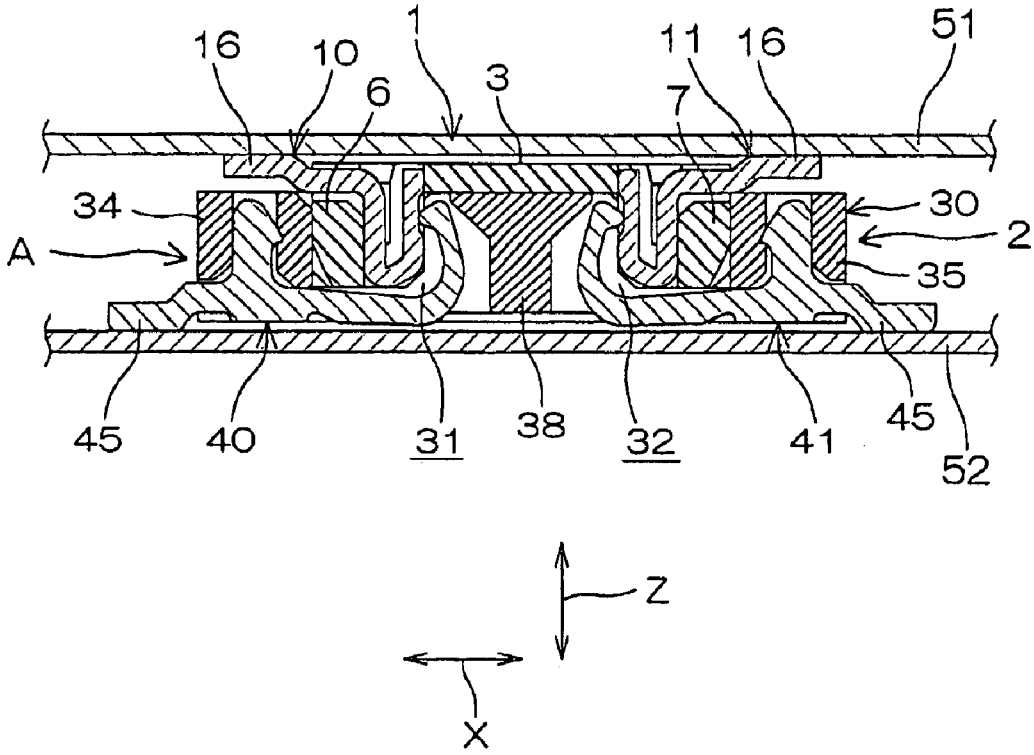
FIG. 8 is a sectional view illustrating engagement between contacts of the first and second connectors.

As shown in FIG. 8, an electrical connector A according to the embodiment of the present invention includes first and second connectors 1, 2 which are engageable with each other. The first connector 1 is, for example, a plug type connector. The second connector 2 is, for example, a receptacle type connector. In this embodiment, an explanation will be given to a case where the electrical connector A is used for so-called board-to-board connection wherein the first and second connectors 1 and 2 are mounted on circuit boards 51 and 52, respectively. However, the present invention is also applicable to board-to-wire connection. The circuit boards 51, 52 each comprise, for example, a printed wiring board.

Figure 1A:
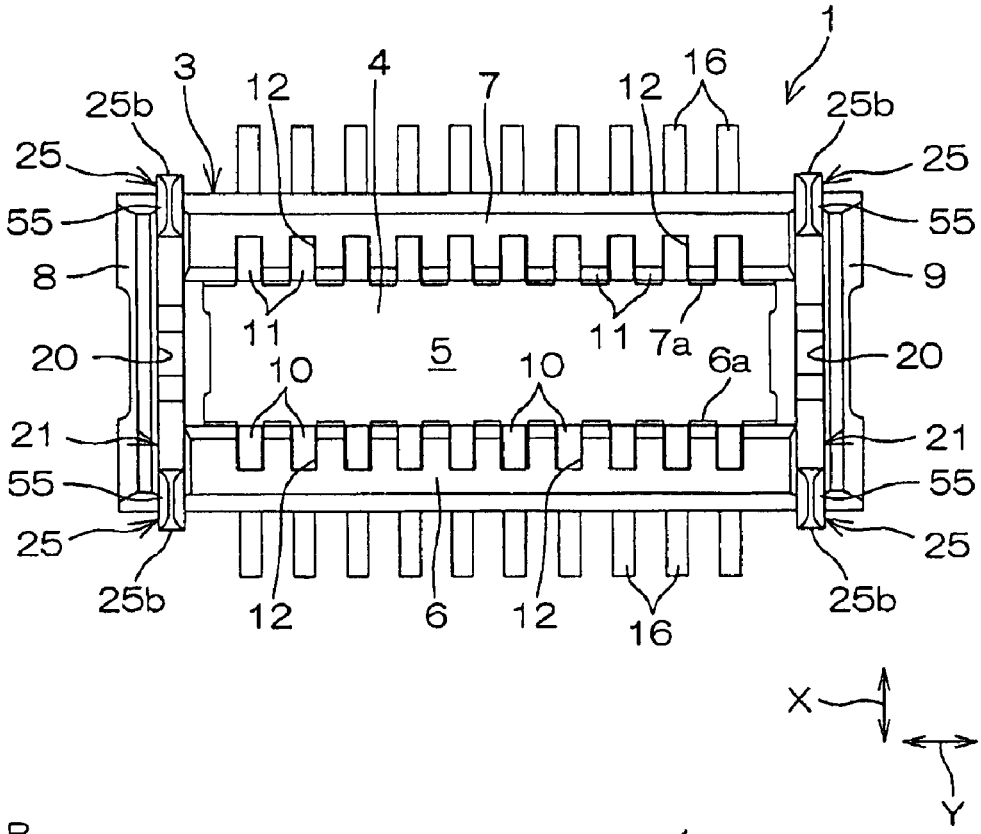
FIGS. 1A and 1B are a plan view and a front view, respectively, illustrating a first connector of an electrical connector according to one embodiment of the present invention.
Figure 1B:
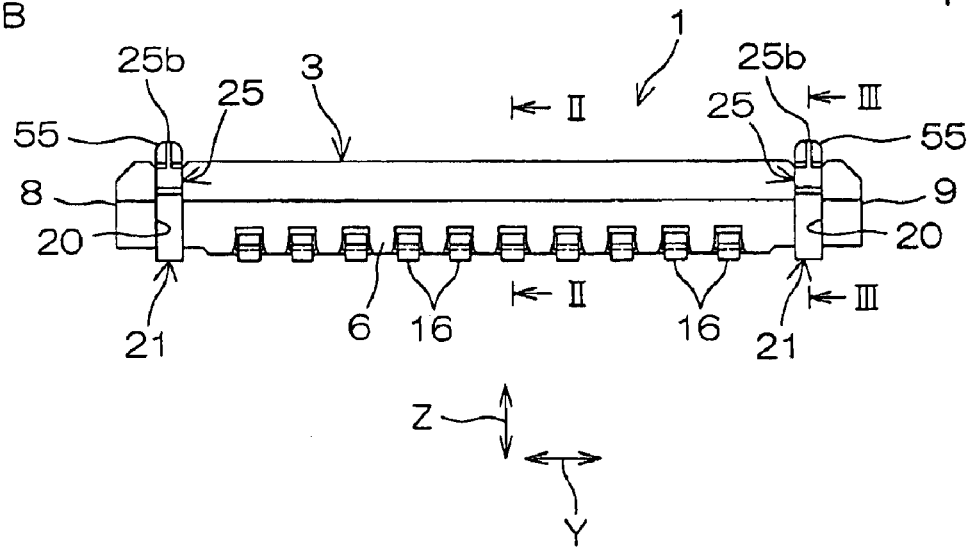

Referring to FIGS. 1A and 1B, the first connector 1 includes a housing 3 composed of an insulative synthetic resin. The housing 3 includes a pair of front and rear contact support walls 6, 7 and a pair of right and left side walls 8, 9 which cooperatively define a rectangular recess 5 on a bottom wall 4 thereof. In FIG. 1A, the pair of contact support walls 6, 7 are opposed to each other in a first direction X (anteroposteriorly in FIG. 1A), and the pair of side walls 8, 9 are opposed to each other in a second direction Y (laterally in FIG. 1B). The first direction X and the second direction Y are perpendicular to each other, and intersecting a connecting direction Z in which the first and second connectors 1, 2 are connected to each other.

The contact support walls 6, 7 each support a plurality of contacts 10, 11 arranged in juxtaposition. More specifically, opposed surfaces 6*a*, 7*a* of the contact support walls 6, 7 each have contact support grooves 12 which open to the recess 5, and the contacts 10, 11 are partly accommodated and retained in the corresponding contact support grooves 12.

Figure 2:
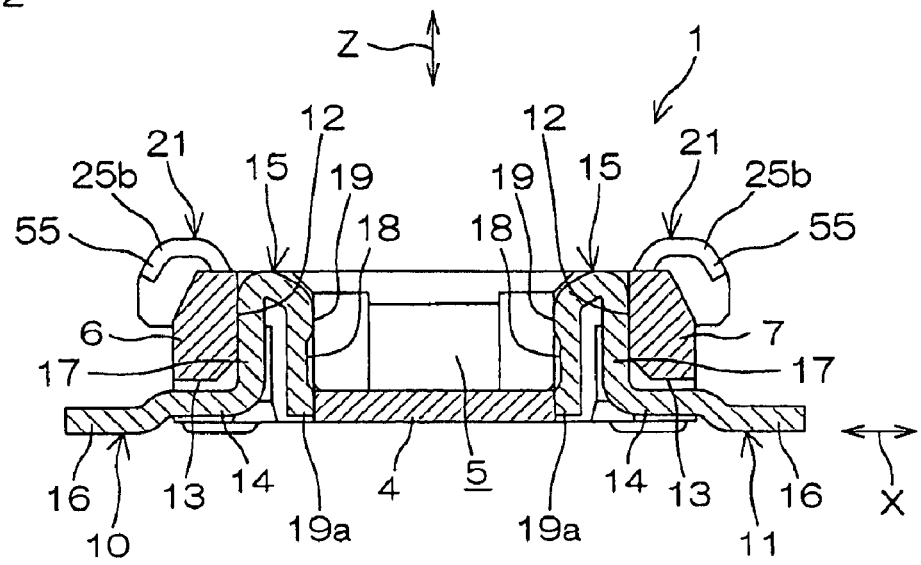
FIG. 2 is a sectional view taken along a line II—II in FIG. 1B.

Referring to FIG. 2, the contacts 10, 11 each include a fixture portion 14, a U-shaped resilient portion 15 and a lead 16. The fixture portion 14 is fixed in a fixture groove 13 provided in a bottom portion of the corresponding contact support wall 6, 7. The resilient portion 15 extends from one end of the fixture portion 14 perpendicularly to the fixture portion 14, and is accommodated and retained in the corresponding contact support groove 12. The lead 16 extends from the other end of the fixture portion 14 as being stepped, and fixed to a conductive portion on the board by soldering.

The U-shaped resilient portion 15 includes a first piece 17 fitted along the bottom of the contact support groove 12, and a second piece 19 having a contact portion 18 which faces the recess 5. A distal end portion 19*a* of the second piece 19 resiliently abuts against an edge of the bottom wall 4.

Referring to FIGS. 1A and 1B, the housing 3 of the first connector 1 has fixture grooves 20 respectively formed in the right and left side walls 8, 9 thereof as extending parallel to the side walls 8, 9. Reinforcement members 21 of metal plates are press-fitted and fixed in the respective fixture grooves 20.

Figure 3:
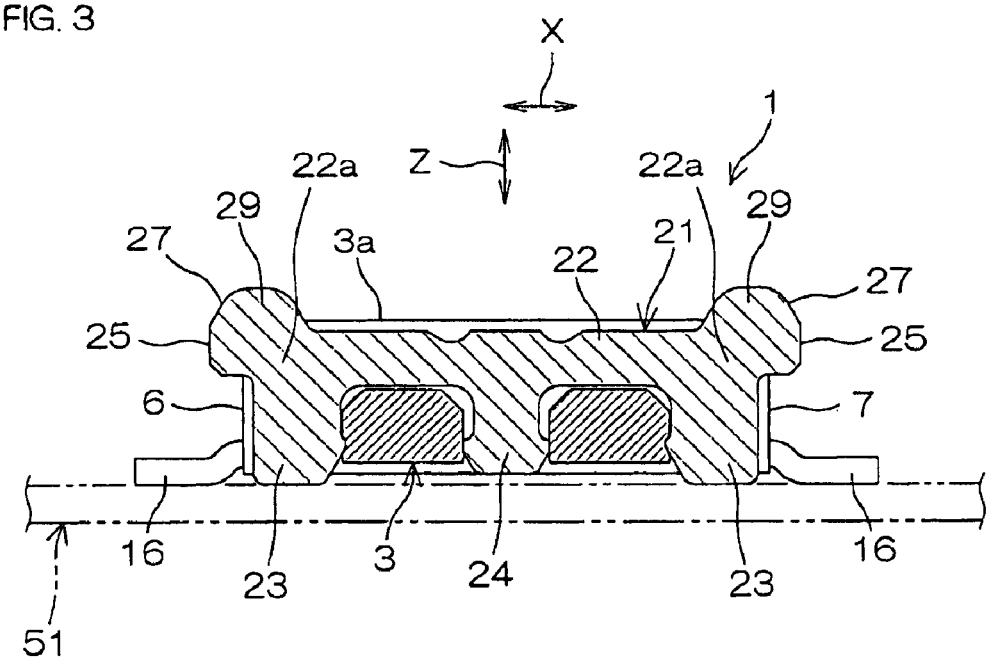
FIG. 3 is a sectional view taken along a line III—III in FIG. 1B.

Referring to FIG. 3, the reinforcement members 21 each include a main portion 22, a pair of fixture portions 23, a press-fit portion 24, and a pair of engagement projections 25. The main portion 22 extends along the fixture groove 20. The fixture portions 23 respectively extend from opposite ends 22*a* of the main portion 22 with respect to the first direction X, and are soldered to a surface of the circuit board 51. The press-fit portion 24 extends from a middle portion of the main portion 22 with respect to the first direction X. The engagement projections 25 respectively project from the opposite ends 22*a* of the main portion 22 with respect to the first direction X. Referring to FIG. 1A, the engagement projections 25 of the respective reinforcement members 21 are disposed in the vicinity of four corners of the housing 3 of the first connector 1.

Figure 7:
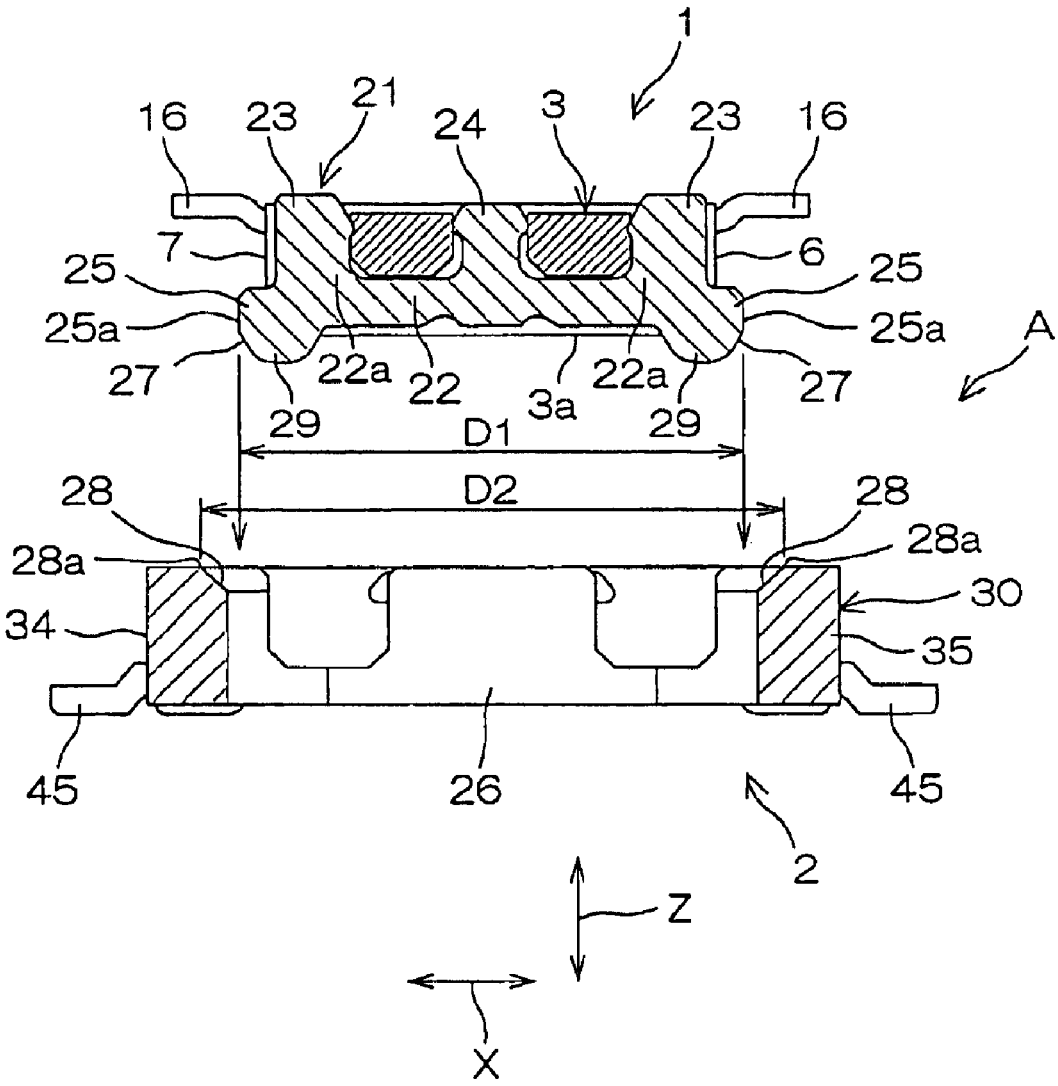
FIG. 7 is an exploded sectional view illustrating a reinforcement tab in section for explaining engagement between the first and second connectors.

As shown in FIG. 7, the reinforcement members 21 each having the pair of engagement projections 25 are introduced into corresponding engagement grooves 26 of the second connector 2 to be described later, whereby the first and second connectors 1, 2 are guided with respect to each other for connection thereof.

Referring to FIGS. 3 and 7, mating portions of the engagement projections 25 and the engagement grooves 26 respectively have first and second oblique guide surfaces 27 and 2B which are obliquely inclined with respect to the connecting direction Z and conformable to each other.

The engagement projections 25 each include a portion 29 projecting from a connection end face 3*a* of the housing 3 of the first connector 1, and at least the projecting portion 29 is provided with the first oblique guide surface 27. The first oblique guide surfaces 27 provided on the opposite ends of each of the reinforcement members 21 are inclined in opposite directions. The second oblique guide surfaces 28 are provided on an opening edge of each of the engagement grooves 26.

As shown in FIG. 7, a difference (D2−D1) between a distance D1 between outer edges 25*a* of the engagement projections 25 and a distance D2 between outer edges 28*a* of the second oblique guide surfaces 28 (D2>D1) corresponds to a permissible positional gap between the connectors 1 and 2 with respect to the first direction X when the connectors 1, 2 are connected with each other. In this embodiment, the engagement projections 25 are provided on the metal reinforcement members 21 which have a higher positioning accuracy and a higher strength. Therefore, a sufficient offset clearance can be provided with respect to the first direction X in the electrical connector having a reduced size.

Figure 4A:
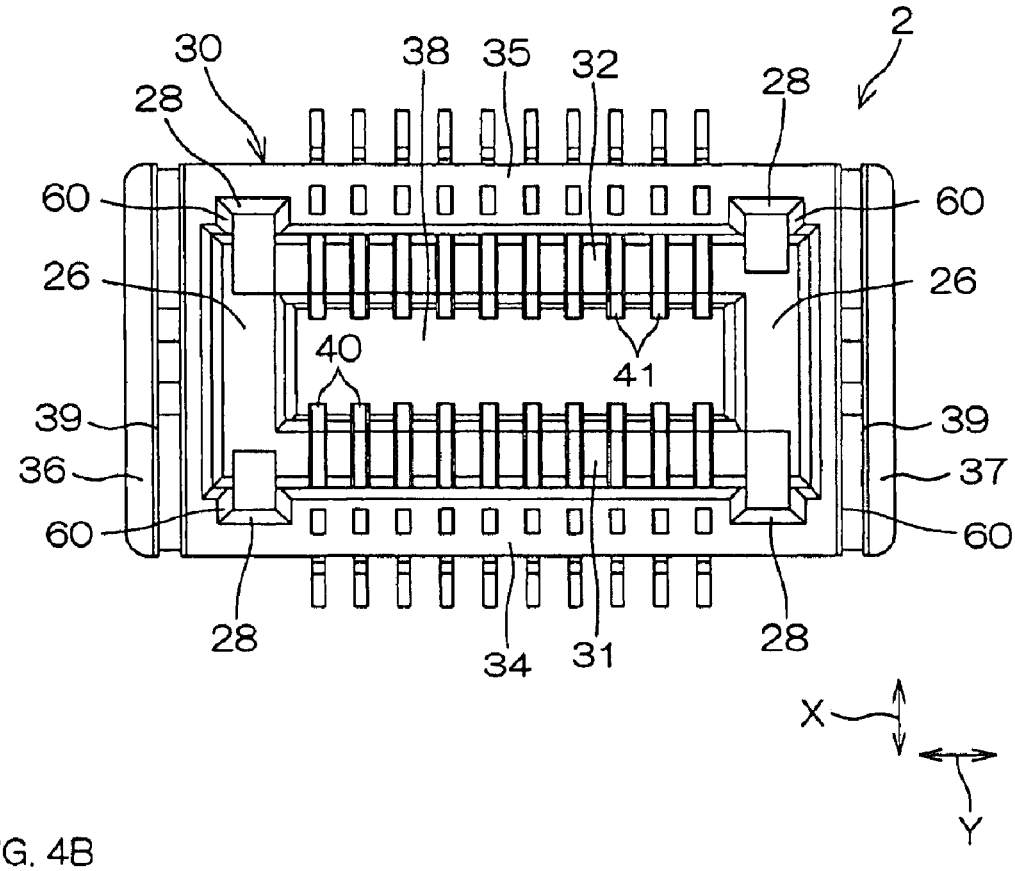
FIGS. 4A and 4B are a plan view and a front view, respectively, illustrating a second connector.

Referring to FIGS. 1A, 1B and 2, connection edges 25*b* of the engagement projections 25 each have chamfered side faces which serve as oblique guide surfaces 55. As shown in FIG. 4A, the engagement grooves 26 each have oblique guide surfaces 60 corresponding to the oblique guide surfaces 55. Therefore, a sufficient offset clearance can be provided between the connectors 1 and 2 with respect to the second direction Y. As a result, a sufficient offset clearance can be provided between the connectors 1 and 2 in an X-Y plane.

Figure 4B:
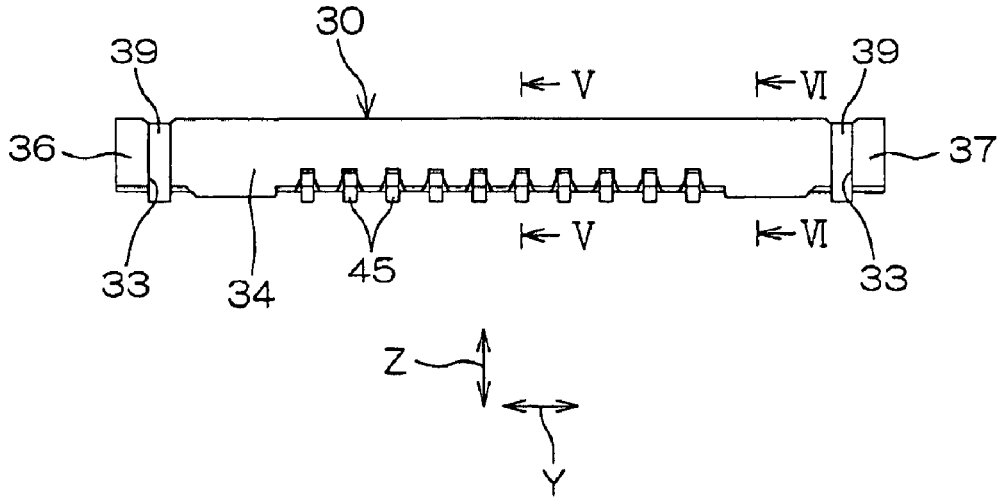

Referring to FIGS. 4A and 4B, the second connector 2 includes a housing 30 composed of an insulative synthetic resin. The housing 30 includes a pair of insertion recesses 31 and 32 which are open for receiving the respective contact support walls 6 and 7 of the first connector 1. The housing 30 includes a first wall 34 and a second wall 35 opposed to each other, and side walls 36 and 37 opposed to each other. The first and second walls 34, 35 each extend in the second direction Y, and the side walls 36, 37 each extend in the first direction X. An intermediate wall 38 is provided between the first wall 34 and the second wall 35 as extending parallel to the first and second walls 34, 35.

The insertion recess 31 is defined between the first wall 34 and the intermediate wall 38, and the insertion recess 32 is defined between the second wall 35 and the intermediate wall 38. The engagement grooves 26 are respectively provided in the vicinity of the side walls 36, 37 as extending parallel to the side walls 36, 37.

Reinforcement members 39 of metal plates are fitted and fixed in fixture grooves 33 provided in the side walls 36 and 37, respectively.

Figure 5:
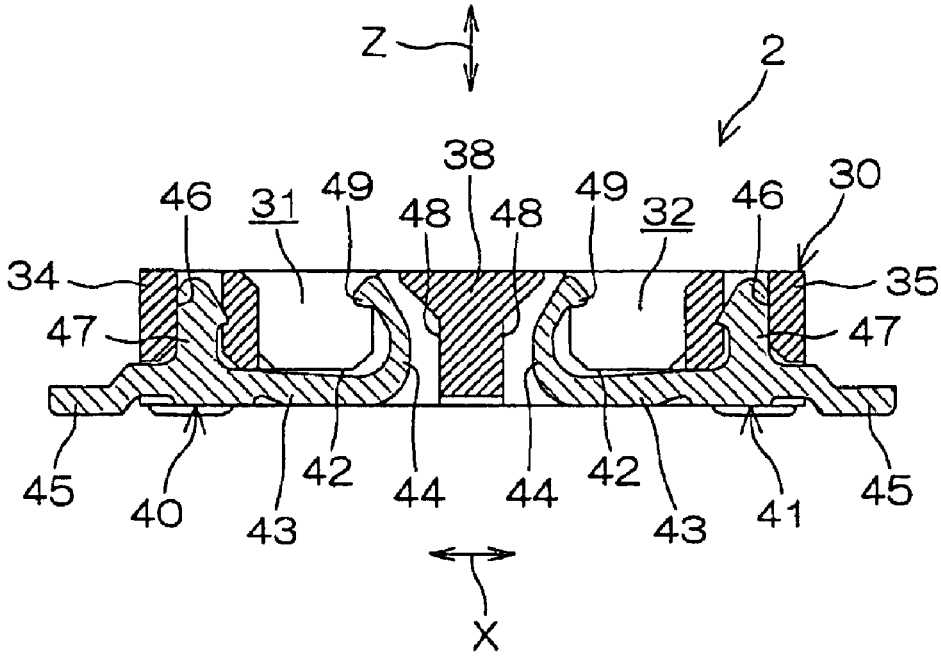
FIG. 5 is a sectional view taken along a line V—V in FIG. 4B.
Figure 6:
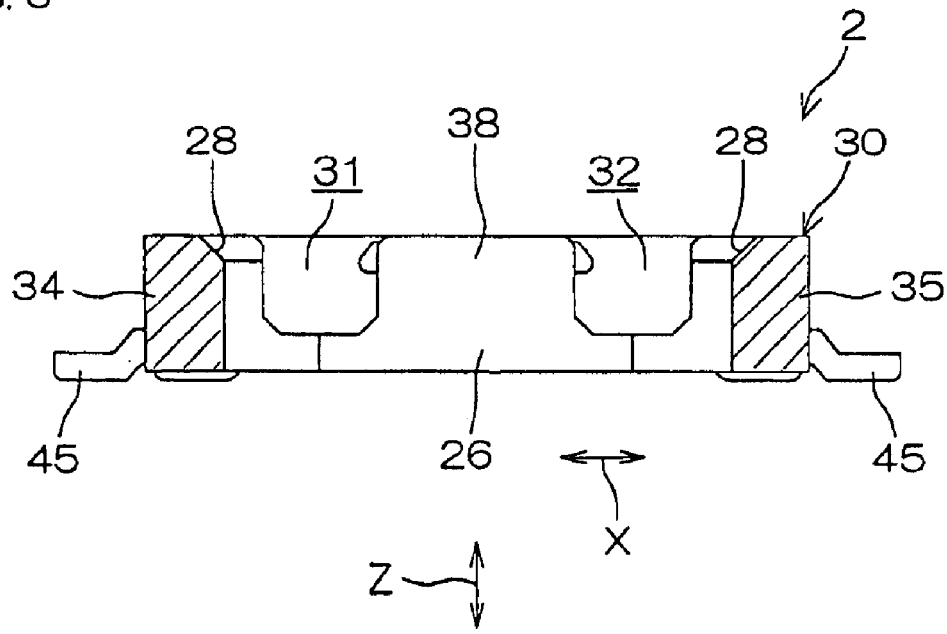
FIG. 6 is a sectional view taken along a line VI—VI in FIG. 4B.

Referring to FIG. 5, contacts 40, 41 arranged in two lines are supported by the housing 30 of the second connector 2. More specifically, the contacts 40, 41 have the same construction but oriented in opposite directions.

The contacts 40, 41 each include a main portion 43 accommodated in a contact support groove 42 provided in the bottom of the housing 30 as extending along the bottom of the housing 30, a resilient portion 44 extending from one end of the main portion 43 as being curved, a lead 45 extending from the other end of the main portion 43 as being stepped and soldered to a surface of the board, and a fixture portion 47 extending from the vicinity of the other end of the main portion 43 perpendicularly to the main portion 43 and press-fitted and fixed in a fixture hole 46 of the corresponding first or second wall 34, 35.

The resilient portion 44 of the contact 40, 41 is retained in a corresponding contact support groove 48 formed in the intermediate wall 38. The resilient portion 44 has an angled projection provided as a contact portion 49 at a distal end thereof.

According to this embodiment, the engagement projections 25 provided on the metal reinforcement members 21 having a higher strength and a higher positioning accuracy are fitted in the engagement grooves 26 of the counterpart connector 2. Therefore, the connectors 1, 2 of the electrical connector A having a reduced size can accurately be guided with respect to each other for connection thereof with a sufficient offset clearance provided therebetween. This contributes to the size reduction of the electrical connector A. For example, the height of the electrical connector A can be reduced to not greater than 2 mm, more specifically about 1.5 mm to 1 mm.

Further, the electrical connector A can be molded from the resin without difficulty unlike the conventional electrical connector which includes the housing provided with the chamfers and the like for guiding.

In general, the reinforcement members 21 are soldered onto the board, so that the leads 16 of the contacts 10, 11 and the like are prevented from being subjected to an external load.

The first and second oblique guide surfaces 27, 28 respectively provided on the engagement projections 25 and the engagement grooves 26 cooperatively assuredly correct the positional gap between the connectors 1 and 2 when the connectors 1, 2 are connected to each other, with making it possible to achieve the height reduction of the connectors 1, 2.

The first oblique guide surfaces 27 are provided on the portions of the engagement projections 25 projecting from the connection end face 3*a* of the housing 3 of the first connector 1. Therefore, the connectors 1, 2 are positioned with respect to each other before the housing 3 and the contacts 10, 11 of the connector 1 are connected to the housing 30 and the contacts 40, 41 of the connector 2. This contributes to easily facilitate the connection.

Since the engagement projections 25 have the portions projecting from the housing 3, the housing 3 and the contacts 10, 11, for example, can be protected by the projecting portions during the transportation and assembly of the connector 1.

Since the reinforcement members 21 each include one pair of engagement projections 25, the first connector 1 has an improved strength with a reduced number of components.

In the aforesaid embodiment, the engagement grooves 26 of the second connector 2 are provided in the housing 30 of the second connector 2, but may also be provided in the metal reinforcement members 39 of the second connector 2.

Further, the present invention is applicable to board-to-wire connection.

While the present invention has been described in detail by way of the specific embodiment thereof, those skilled in the art who understand the foregoing disclosure will easily come up with modifications, variations and equivalents of the invention. Therefore, it should be understood that the scope of the invention be defined by the following claims and the equivalents thereof.

What is claimed is:

1. An electrical connector comprising:

first and second connectors which are connectable to each other in a predetermined connecting direction;

the first connector comprising a rectangular housing, a plurality of contacts supported by the housing, and a flat metal reinforcement member fixed to the housing and extending in a first direction perpendicular to the connecting direction;

two flat mental reinforcement members including a pair of engagement projections projecting in the connection direction;

the second connector comprising an engagement groove engageable with the reinforcement member;

wherein the first and second connectors are permitted to be offset from each other in the first direction intersecting the connecting direction and guided with respect to each other for connection thereof when the pair of engagement projections of the reinforcement member are introduced into the engagement groove; and wherein the two flat metal reinforcement members and engagement projections of the two flat metal reinforcement members are disposed in the vicinity of four corners of the housing of the first connector respectively.

2. The electrical connector according to claim 1, wherein the second connector comprises a housing, and a plurality of contacts supported by the housing thereof, wherein the engagement groove is provided in the housing of the second connector.

3. The electrical connector according to claim 1, wherein the two reinforcement members are respectively provided in association with two engagement grooves.

4. The electrical connector according to claim 3, wherein the housing of the first connector comprises a pair of opposed side walls extending in the first direction, and a pair of fixture grooves respectively extending along the side walls, wherein the two reinforcement members are respectively fixed in the corresponding fixture grooves of the housing of the first connector.

5. The electrical connector according to claim 4, wherein the reinforcement members each include a main portion extending along the corresponding fixture groove, wherein the engagement projections of each of the reinforcement members project from opposite ends of the main portion in the first direction.

6. The electrical connector according to claim 1, wherein the first connector comprises a connector mounted on a circuit board;

wherein the reinforcement member is soldered to the circuit board.

7. An electrical connector comprising:

first and second connectors which are connectable to each other in a predetermined connecting direction;

the first connector comprising a housing, a plurality of contacts supported by the housing, and a metal reinforcement member fixed to the housing and extending in a first direction perpendicular to the connecting direction;

the reinforcement member including a pair of engagement projections;

the second connector comprising an engagement groove engageable with the reinforcement member;

wherein the first and second connectors are permitted to be offset from each other in the first direction intersecting the connecting direction and guided with respect to each other for connection thereof when the pair of engagement projections of the reinforcement member are introduced into the engagement groove;

wherein the engagement projections of the reinforcement member respectively include first oblique guide surfaces which are inclined in opposite directions;

wherein the engagement groove associated with the reinforcement member includes a pair of second oblique guide surfaces which are inclined in opposite directions;

wherein the first oblique guide surfaces and the second oblique guide surfaces are inclined in opposite directions;

wherein the first oblique guide surfaces are engageable with the corresponding second oblique guide surfaces for guiding the first and second connectors with respect to each other for connection of the first and second connectors.

8. The electrical connector according to claim 7, wherein the housing of the first connector has a connection end face to be opposed to the second connector, wherein the engagement projections respectively include portions projecting from the connection end face of the housing of the first connector, wherein the first oblique guide surfaces are respectively provided on at least the corresponding projecting portions.

9. The electrical connector according to claim 7, wherein a distance between outer edges of the pair of engagement projections of the reinforcement member is smaller than a distance between outer edges of the pair of second oblique guide surfaces of the corresponding engagement groove.

* * * * *